US007518074B2

(12) United States Patent
Weister et al.

(10) Patent No.: US 7,518,074 B2
(45) Date of Patent: Apr. 14, 2009

(54) ELECTRICAL SWITCHING APPARATUS, AND CARRIER ASSEMBLY AND INDEPENDENT PIVOT ASSEMBLY THEREFOR

(75) Inventors: Nathan J. Weister, Darlington, PA (US); Paul R. Rakus, Beaver Falls, PA (US)

(73) Assignee: Eaton Corporation, Cleveland, OH (US)

( * ) Notice: Subject to any disclaimer, the term of this patent is extended or adjusted under 35 U.S.C. 154(b) by 168 days.

(21) Appl. No.: 11/549,316

(22) Filed: Oct. 13, 2006

(65) Prior Publication Data

US 2008/0087537 A1 Apr. 17, 2008

(51) Int. Cl.
*H01H 77/00* (2006.01)

(52) U.S. Cl. ..... 200/244; 335/15

(58) Field of Classification Search ..... 200/244, 200/260, 325, 553, 560, 250, 400, 401; 335/6, 335/15, 16, 190–195
See application file for complete search history.

(56) References Cited

U.S. PATENT DOCUMENTS 4,733,033 A * 3/1988 Morris et al. ..... 200/401
5,200,724 A 4/1993 Gula et al.
5,874,699 A * 2/1999 Beck et al. ..... 200/244
5,899,323 A 5/1999 Rakus
6,005,206 A 12/1999 Rakus et al.
6,570,116 B2 5/2003 Maulandi et al.
6,777,636 B2 * 8/2004 Ahlert et al. ..... 200/401
6,977,568 B1 12/2005 Rakus et al.
7,034,642 B1 4/2006 Rakus et al.
7,238,910 B1 * 7/2007 Puskar et al. ..... 218/154

* cited by examiner

*Primary Examiner*—Elvin G Enad
*Assistant Examiner*—Marina Fishman
(74) *Attorney, Agent, or Firm*—Charles E. Kosinski

(57) ABSTRACT

A pivot assembly is provided for an electrical switching apparatus, such as a circuit breaker, including a housing having a molded cover and a molded base, a stationary contact assembly with stationary electrical contacts, and a movable contact assembly. The movable contact assembly includes at least one carrier assembly with a pivot, movable contact arms pivotably coupled to the carrier assembly, and movable electrical contacts coupled to the movable contact arms. The pivot assembly includes pivot members. Each pivot member includes an aperture for pivotably receiving the pivot of the carrier assembly in order that the carrier assembly is pivotably coupled between a corresponding pair of pivot members. Each pivot member is a separate independent component disposed between the molded cover and molded base of the circuit breaker housing. An electrical switching apparatus and a carrier assembly are also disclosed.

20 Claims, 9 Drawing Sheets

ELECTRICAL SWITCHING APPARATUS, AND CARRIER ASSEMBLY AND INDEPENDENT PIVOT ASSEMBLY THEREFOR

CROSS-REFERENCE TO RELATED APPLICATIONS

This application is related to commonly assigned, concurrently filed:

U.S. patent application Ser. No. 11/549,309, filed Oct 13, 2006, entitled "ELECTRICAL SWITCHING APPARATUS, AND MOVABLE CONTACT ASSEMBLY AND CONTACT SPRING ASSEMBLY THEREFOR"; and U.S. patent application Ser. No. 11/549,277, filed Oct 13, 2006, entitled "ELECTRICAL SWITCHING APPARATUS, AND CONDUCTOR ASSEMBLY, AND INDEPENDENT FLEXIBLE CONDUCTIVE ELEMENTS THEREFOR"; and U.S. patent application Ser. No. 11/549,294, filed Oct 13, 2006, entitled "ELECTRICAL SWITCHING APPARATUS, AND HOUSING AND INTEGRAL POLE SHAFT BEARING ASSEMBLY THEREFOR", all of which are hereby incorporated herein by reference.

BACKGROUND OF THE INVENTION

1. Field of the Invention

The invention relates generally to electrical switching apparatus and, more particularly, to an electrical switching apparatus, such as a circuit breaker, having a carrier assembly with a pivot assembly. The invention also relates to carrier assemblies for circuit breakers. The invention further relates to pivot assemblies for circuit breakers.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions.

Many low-voltage circuit breakers, for example, employ a molded housing having two parts, a first half or front part (e.g., a molded cover), and a second half or rear part (e.g., a molded base). The operating mechanism for such circuit breakers is often mounted to the front part of the housing, and typically includes an operating handle and/or button(s) which, at one end, is (are) accessible from the exterior of the molded housing and, at the other end, is (are) coupled to a pivotable pole shaft. Electrical contact assemblies, which are also disposed within the molded housing, generally comprise a conductor assembly including a movable contact assembly having a plurality of movable contacts, and a stationary contact assembly having a plurality of corresponding stationary contacts. The movable contact assembly is electrically connected to a generally rigid conductor of the conductor assembly by flexible conductors, commonly referred to as shunts. The movable contact assembly includes a plurality of movable contact arms or fingers, each carrying one of the movable contacts and being pivotably coupled to a contact arm carrier. The contact arm carrier is pivoted by a protrusion or arm on the pole shaft of the circuit breaker operating mechanism to move the movable contacts into and out of electrical contact with the corresponding stationary contacts of the stationary contact assembly. The contact arm carrier includes a contact spring assembly structured to bias the fingers of the movable contact assembly against the stationary contacts of the stationary contact assembly in order to provide and maintain contact pressure when the circuit breaker is closed, and to accommodate wear.

The accuracy with which circuit breaker components such as, for example, the operating mechanism, the contact arm carrier, the pivotable pole shaft, and the movable and stationary contact assemblies, are mounted with respect to one another within the molded housing of the circuit breaker significantly affects circuit breaker performance. Specifically, accurate mounting configuration of circuit breaker components results in consistent, reliable kinematics of the circuit breaker, and predictable and thus repeatable mechanical, electrical and thermal circuit breaker performance.

In various known low-voltage circuit breakers, a pivot of the contact arm carrier, such as a pivot pin, is pivotably secured directly between the two parts or halves of the molded circuit breaker housing. More specifically, the pin is disposed between a pair of semi-circles which are molded in the first and second halves of the circuit breaker housing, respectively, and are jointed to form the pivot recess for receiving the pivot pin when the two halves of the housing are coupled together. Such a circuit breaker is susceptible to misalignment and, therefore, can be problematic. Moreover, it fails to provide a good dielectric barrier between adjacent poles of the circuit breaker, particularly at the location where the halves of the circuit breaker housing join to form the carrier pivot recesses. At that location, only a relatively weak labyrinth seal (e.g., a seal comprised of small overlaps between the two housing halves), with relatively little wall thickness, exists.

Manufacturing tolerance discrepancies such as, for example, tolerance discrepancies between the first half or front part of the circuit breaker molded housing, and the second half or back part of the molded housing contribute to misalignment between circuit breaker components. Such discrepancies can result in accumulated dimensional error which can cause, for example, binding or excessive looseness in the pivot members of the contact arm carrier.

Space constraints within the molded housing and cost considerations also serve to limit and/or dictate the mounting options which are available for a particular circuit breaker component. For example, in other known low-voltage circuit breakers, the bearing structure for pivotably securing the contact arm carrier to the molded housing comprises a separate component which is coupled to one or both halves of the molded housing by a plurality of fasteners. Such circuit breakers undesirably add to the complexity and expense thereof.

There is, therefore, room for improvement in electrical switching apparatus, such as low-voltage circuit breakers, and in carrier assemblies and carrier pivots therefor.

SUMMARY OF THE INVENTION

These needs and others are met by embodiments of the invention, which are directed to a carrier assembly for an electrical switching apparatus such as, for example, a low-voltage circuit breaker, having a carrier assembly with independent carrier pivot members.

As one aspect of the invention, a pivot assembly is provided for an electrical switching apparatus. The electrical switching apparatus includes a housing having a molded cover and a molded base, a stationary contact assembly and a movable contact assembly. The movable contact assembly includes at least one carrier assembly, and is movable into and out of electrical contact with the stationary contact assembly. The carrier assembly includes a pivot, and the pivot assembly comprises: a plurality of pivot members, each of the pivot members including an aperture structured to pivotably receive the pivot of the at least one carrier assembly in order that the at least one carrier assembly is pivotably coupled between a corresponding pair of the pivot members, wherein each of the pivot members is a separate independent component structured to be disposed between the molded cover of the housing of the electrical switching apparatus and the molded base of the housing of the electrical switching apparatus.

The pivot of the carrier assembly may comprise at least one pivot pin, and the aperture of each of the pivot members may comprise a substantially circular pivot recess having a full, continuous diameter for receiving a corresponding pivot pin of the carrier assembly. The electrical switching apparatus may include a plurality of carrier assemblies, wherein the pivot members comprise a pair of end pivot members and a number of intermediate pivot members disposed between the pair of end pivot members, and wherein each of the carrier assemblies is pivotably coupled to and disposed between: (a) one of the intermediate pivot members, and (b) another one of the intermediate pivot members or one of the pair of end pivot members. Each of the intermediate pivot members may have a first side including a first pivot recess structured to pivotably receive the pivot pin of one of the carrier assemblies, and a second side having a second pivot recess structured to pivotably receive the pivot pin of another one of the carrier assemblies.

Each of the pivot members may comprise at least one protrusion and at least one cut-out portion, wherein the protrusion is structured to engage one of the molded cover of the housing of the electrical switching apparatus and the molded base of the housing of the electrical switching apparatus, and wherein the cut-out portion is structured to engage the other one of the molded cover and the molded base in order to secure the pivot members therebetween, without requiring the use of separate fasteners.

As another aspect of the invention, a carrier assembly is provided for an electrical switching apparatus including a housing having a molded cover and a molded base, a stationary contact assembly having a plurality of stationary electrical contacts, and a movable contact assembly. The carrier assembly comprises: a first carrier member; a second carrier member; a plurality of movable contact arms pivotably coupled between the first carrier member and the second carrier member; a plurality of movable electrical contacts coupled to the movable contact arms and being structured to be movable into and out of electrical contact with the stationary electrical contacts of the stationary contact assembly; a pivot extending outwardly from the first carrier member of the carrier assembly and the second carrier member of the carrier assembly; and a pivot assembly comprising: a pair of pivot members, each of the pivot members including an aperture pivotably receiving the pivot of the carrier assembly in order that the carrier assembly is pivotably coupled therebetween, wherein each of the pair pivot members is a separate independent component structured to be disposed between the molded cover of the housing of the electrical switching apparatus and the molded base of the housing of the electrical switching apparatus.

As another aspect of the invention, an electrical switching apparatus comprises: a housing including a molded cover and a molded base; a stationary contact assembly having a plurality of stationary electrical contacts; and a movable contact assembly including at least one carrier assembly, each of the at least one carrier assembly comprising: a first carrier member, a second carrier member, a plurality of movable contact arms pivotably coupled between the first carrier member and the second carrier member, a plurality of movable electrical contacts coupled to the movable contact arms and being movable into and out of electrical contact with the stationary electrical contacts of the stationary contact assembly, a pivot extending outwardly from the first carrier member and the second carrier member, and a pivot assembly comprising: a plurality of pivot members, each of the pivot members including an aperture pivotably receiving the pivot of a corresponding one of the at least one carrier assembly in order that the corresponding one of the at least one carrier assembly is pivotably coupled between a pair of the pivot members, wherein each of the pivot members of the pivot assembly is a separate independent component disposed between the molded cover of the housing of the electrical switching apparatus and the molded base of the housing of the electrical switching apparatus.

The electrical switching apparatus may be a circuit breaker having a plurality of poles, and a plurality of carrier assemblies for the poles of the circuit breaker. The housing of the circuit breaker may comprise a plurality of substantially vertical walls molded in the molded cover of the circuit breaker housing and in the molded base of the circuit breaker housing, respectively, wherein when the molded cover of the circuit breaker housing and the molded base of the circuit breaker housing are assembled, each of the substantially vertical walls of the molded cover generally aligns with a corresponding one the substantially vertical walls of the molded base to form a plurality of separate cavities for the poles of the circuit breaker, and wherein each of the pivot members of the pivot assembly is clam-shelled between a corresponding pair of the substantially vertical walls of the molded cover and the substantially vertical walls of the molded base, thereby providing substantially unobstructed access to the separate cavities. Each of the substantially vertical walls of the molded cover of the circuit breaker housing and the substantially vertical walls of the molded base of the circuit breaker housing may have a first thickness, and each of the pivot members of the pivot assembly may have a second thickness, wherein the second thickness of the pivot members of the pivot assembly is greater than the first thickness of the walls of the housing, in order that the pivot members provide a dielectric barrier between the poles of the circuit breaker.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
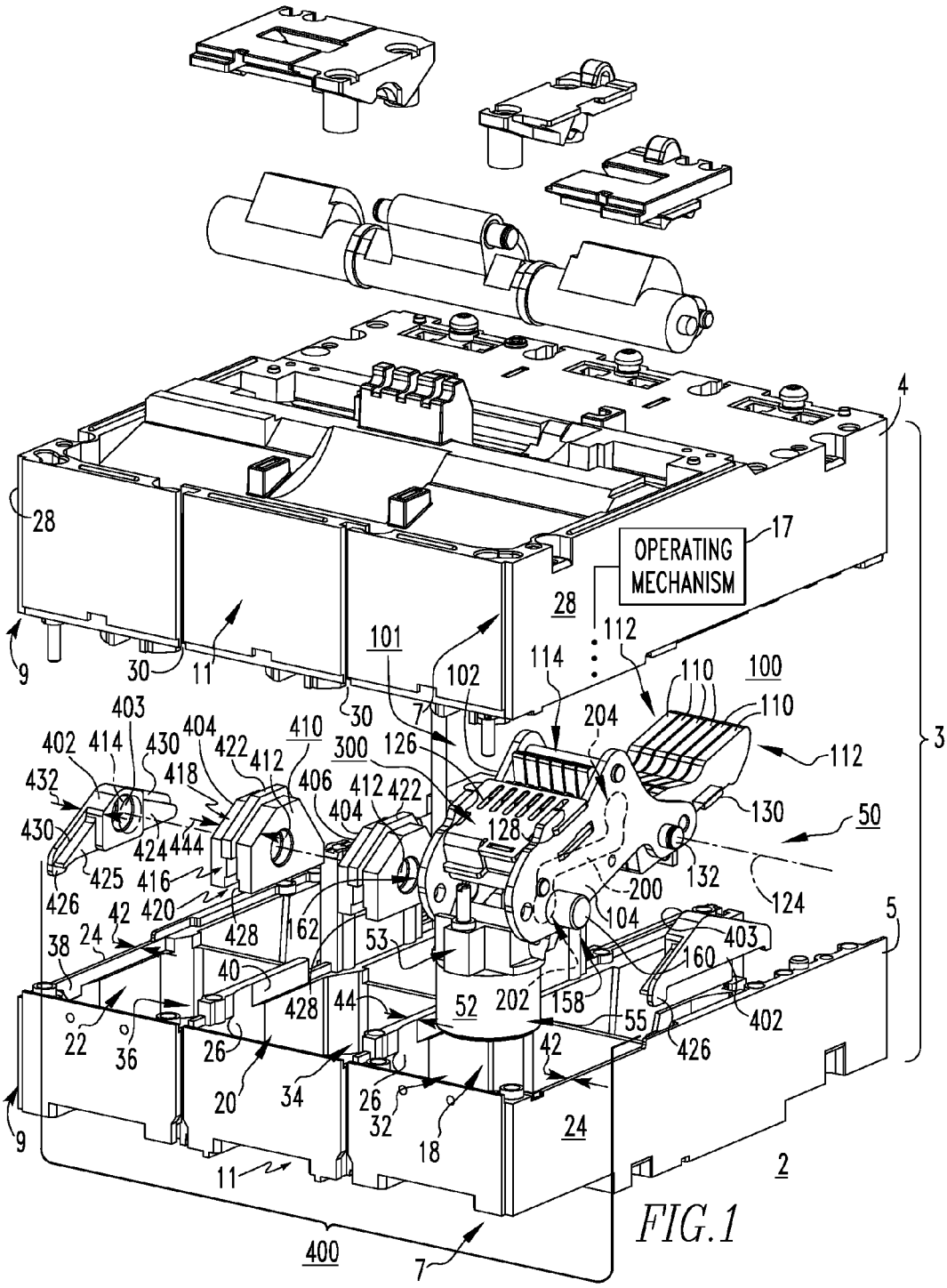
FIG. 1 is an exploded isometric view of a low-voltage circuit breaker including a conductor assembly, a carrier assembly and an independent pivot assembly in accordance with an embodiment of the invention.

For purposes of illustration, embodiments of the invention will be described as applied to the carrier assembly of a low-voltage circuit breaker, although it will become apparent that they could also be applied to minimize, for example, manufacturing tolerance variations between the components of any known or suitable electrical switching apparatus (e.g., without limitation, circuit switching devices and circuit interrupters such as circuit breakers other than low-voltage circuit breakers, network protectors, contactors, motor starters, motor controllers and other load controllers).

Directional phrases used herein, such as, for example, left, right, clockwise, counterclockwise and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows a low-voltage circuit breaker 2 including a housing 3 which encloses a conductor assembly 50 having a movable contact assembly 100 with flexible conductive elements 200 (one flexible element 200 is shown in hidden line drawing in simplified form in FIG. 1), in accordance with embodiments of the invention. The housing 3 includes a first half or front part 4 (e.g., a molded cover) and a second half or back part 5 (e.g., a molded base), with the conductor assembly 50 being disposed therebetween. The low-voltage circuit breaker 2 further includes first and second conductors such as the example line and load conductors 6,8 partially shown in phantom line drawing in simplified form in FIG. 3.

Figure 2:
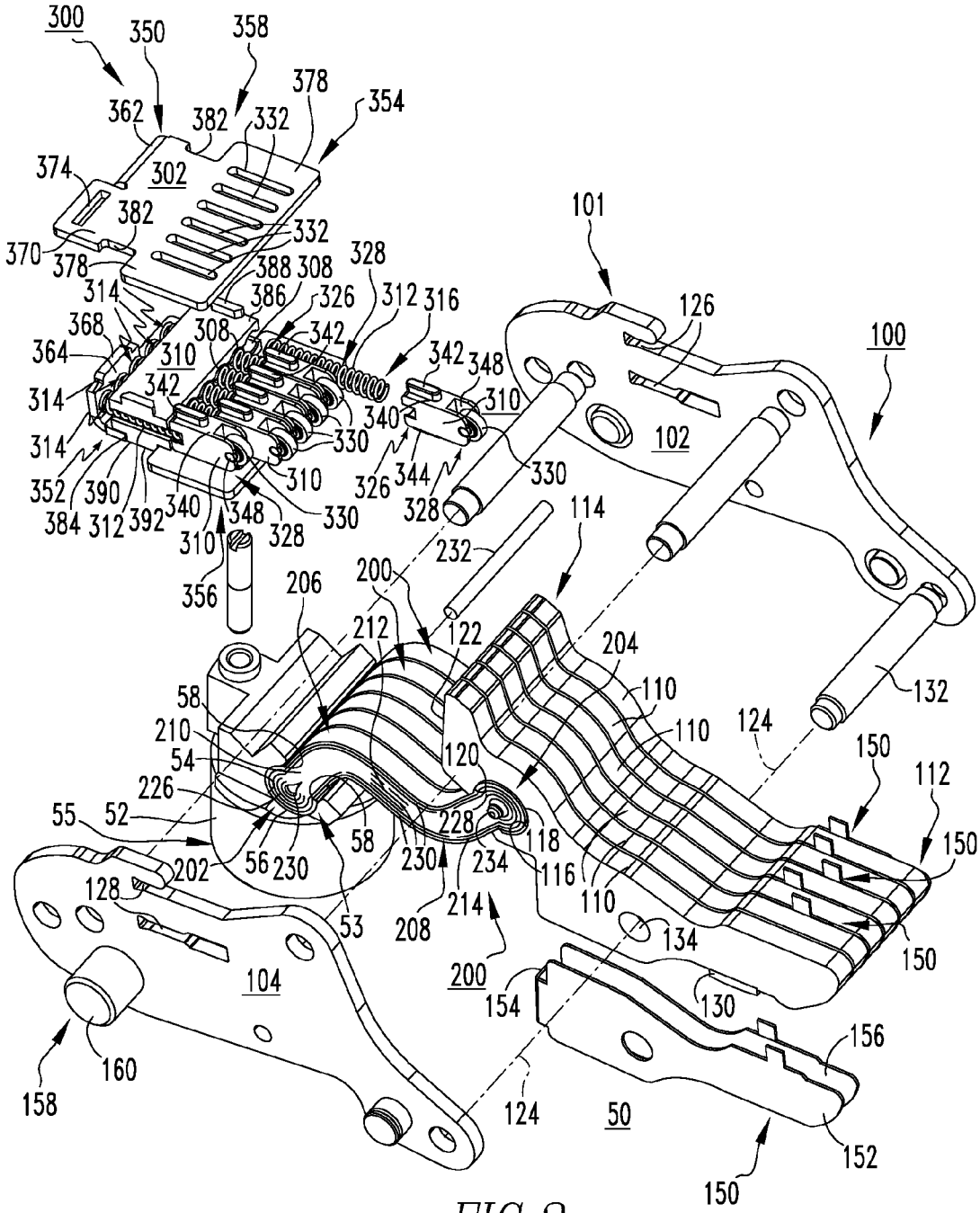
FIG. 2 is an exploded isometric view of the conductor assembly of FIG. 1.
Figure 3:
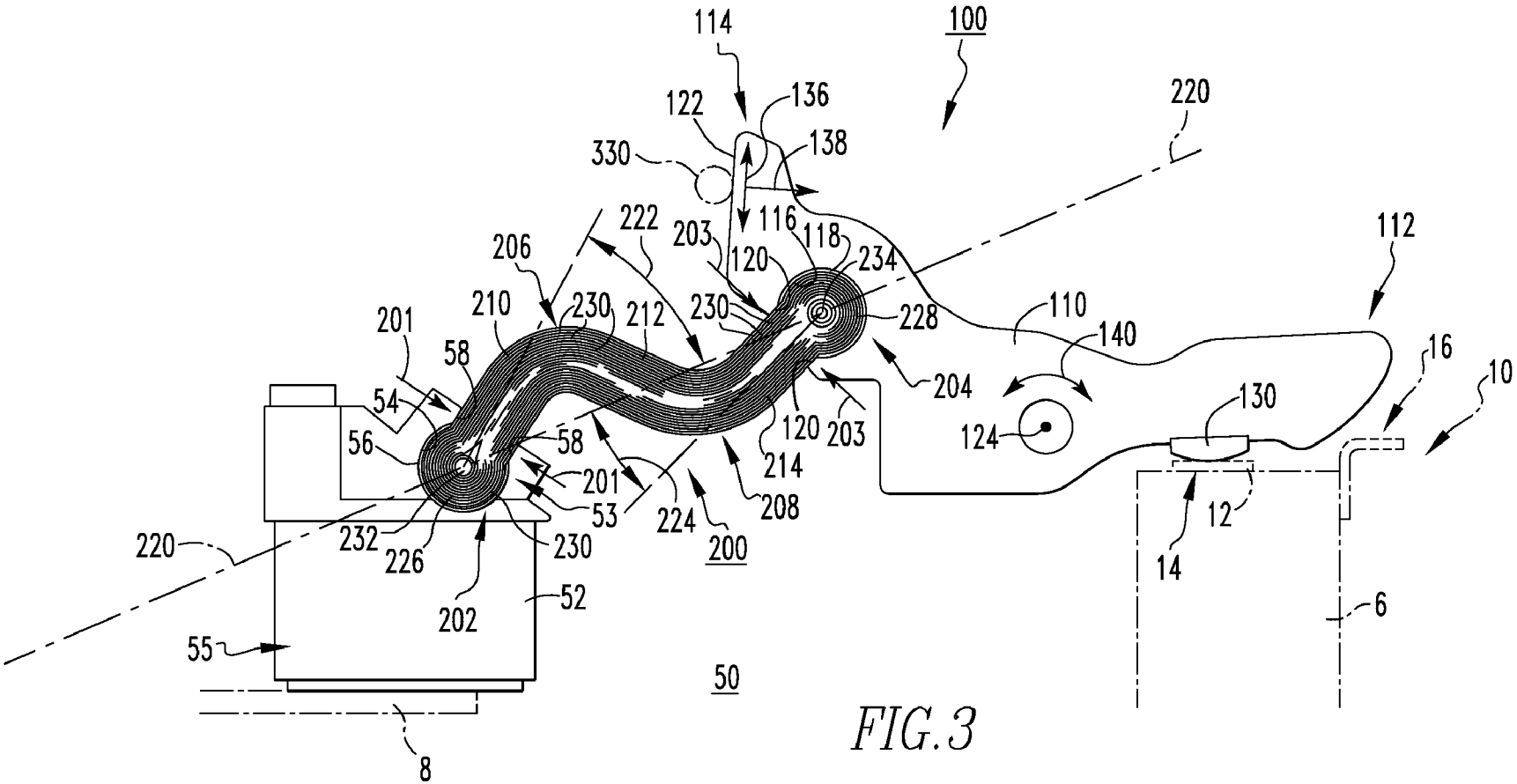
FIG. 3 is a side elevational view of a portion of the conductor assembly of FIG. 1.

As shown in FIGS. 2 and 3, the conductor assembly 50 includes a load conductor 52, a movable contact assembly 100, and a plurality of the flexible conductive elements 200 electrically connecting the load conductor 52 and the movable contact assembly 100. The movable contact assembly 100 includes a plurality of movable contact arms 110. Each of the movable contact arms 110 has a first end 112 and a second end 114. A movable electrical contact 130 is coupled to each movable contact arm 110 at or about the first end 112 thereof, and is structured to move into and out of electrical contact with a corresponding stationary electrical contact 12 (FIG. 3) of the low-voltage circuit breaker 2 (FIG. 1). Specifically, as shown in FIG. 3, the first electrical conductor or line conductor 6 of the circuit breaker 2 (FIG. 1) includes a stationary contact assembly 10 (shown in phantom line drawing in simplified form) having a plurality of stationary electrical contacts 12 (one stationary electrical contact 12 is shown in FIG. 3).

When the conductor assembly 50 is assembled within the circuit breaker housing 3 (FIG. 1) the load conductor 52 is in electrical contact with the second electrical conductor or load conductor 8 of the circuit breaker 2 and the movable electrical contact 130 is movable into (FIG. 3) and out of (not shown) electrical contact with the corresponding stationary electrical contact 12 of the stationary contact assembly 10. It will be appreciated that, for simplicity of illustration, only one conductor assembly 50 is shown in the figures. Typically, however, the low-voltage circuit breaker 2, shown in FIG. 1, which is a three-pole circuit breaker 2, would include three such conductor assemblies 50, one for each of the poles of the circuit breaker 2. It will further be appreciated that the conductor assembly 50 could be employed with any known or suitable electrical switching apparatus having any number of poles other than the three-pole low-voltage circuit breaker 2 shown and described in connection with FIG. 1.

Referring to FIGS. 2 and 3, each of the flexible conductive elements 200 which electrically connect the load conductor 52 of the conductor assembly 50 to the movable contact assembly 100, includes a first end 202 structured to be electrically connected to the load conductor 52, a second end 204 structured to be electrically connected to a corresponding one of the movable contact arms 110 of the movable contact assembly 100, and a plurality of bends 206,208 between the first end 202 and the second end 204. As best shown in FIG. 3, a first one of the bends 206 is in a first direction and at least a second one of the bends 208 is in a second direction which is generally opposite the first direction of the first bend 206. More specifically, the example flexible conductive element 200 is a shunt comprising layered conductive ribbon 230 (shown exaggerated in FIGS. 2 and 3 for ease of illustration), and includes two bends 206,208, a first bend 206 in the first direction, and a second bend 208 in the second direction in order that the shunt 200 is generally S-shaped. Accordingly, the shunt 200 includes a first portion 210 disposed between the first end 202 and the first bend 206, a second portion 212 disposed between first bend 206 and second bend 208, and a third portion 214 disposed between second bend 208 and the second end 204 of the shunt 200. The generally S-shape configuration of the shunt 200 permits it to have a relatively low profile in a vertical direction, thus minimizing the amount of space required for the conductor assembly 50 within the circuit breaker housing 2 (FIG. 1).

An axis 220 extends between the first end 202 of the shunt 200 and the second end 204 of the shunt 200. The first portion 210 of the shunt 200 forms a first angle 222 with respect to axis 220 on one side of the axis, and the third portion 214 of the shunt 200 forms a second angle 224 with respect to the axis 220, on the opposite side of the axis 220. Preferably the first and second angles 222,224 of the first and third portions 210,214 of shunt 200, are different. For example, the first angle 222 of the shunt 200 of FIG. 3 is greater than second angle 224. By way of a non-limiting example, the first angle 222 of the example shunt 200 is between about 26 degrees and about 36 degrees with respect to axis 220, and the second angle 224 is between about 11 degrees and about 22 degrees. It will, however, be appreciated that any known or suitable shunt configuration could be employed in accordance with embodiments of the invention to accommodate the compound motion of the conductor assembly 50 while minimizing areas of stress concentration in the shunts 200 and providing a compact shunt design. It will also be appreciated that while the shunt 200 is contemplated as being made from wound layered conductive ribbon 230 which is made of copper, that any known or suitable electrically conductive material could alternatively be employed without departing from the scope of the invention. Likewise, while the example shunt 200 has about 58 layers of conductive ribbon 230, a width of about 0.35 inches, a length of about 2.2 inches (measured from the center of the first end 202 of shunt 200 to the center of the second end 204 thereof), an overall thickness of about 0.187 inches, and a ribbon layer thickness of about 0.003 inches, it will be appreciated that one or more of these dimensions could be changed to any known or suitable value as necessary for the particular application in which the shunt 200 will be used.

Continuing to refer to FIGS. 2 and 3, the load conductor 52 of the conductor assembly 50 comprises a solid conductor 52 having a first portion 53 and a second portion 55 generally opposite the first portion 53. The first portion 53 includes a first aperture which generally comprises a single elongated recess 54 (best shown in FIG. 2). The single elongated recess 54 receives the first ends 202 of all of the shunts 200. The second ends 204 of the shunts 200 are received in corresponding second apertures 116 in the second ends 114 of each of the movable contact arms 110 (six shunts 200 are shown in FIG. 2). More specifically, the first end 202 of each shunt 200 comprises a first generally round head 226 and the second end 204 of the shunt 200 comprises a second generally round head 228. The single elongated recess 54 of the load conductor 52 and the second aperture 116 of the corresponding movable contact arms 110 each comprise an interior arcuate portion 56,118 and a neck portion 58,120, respectively, as shown. The first generally round head 226 of the first end 202 of shunt 200 is disposed within the interior arcuate portion 56 of the first aperture or single elongated recess 54 of the load conductor 52, as shown, and the neck portion 58 of the first aperture 54 is compressed against shunt 200 in the direction indicated by arrows 201 of FIG. 3 in order to retain the first end 202 of the shunt 200 within the first aperture 54. Similarly, the second generally round head 228 is disposed within the second aperture 116 of the corresponding movable contact arm 110, and the second end 204 of the shunt 200 is retained within the interior arcuate portion 118 of the second aperture 116. Such retention can be provided by the neck portion 120 of the second aperture 116 being compressed against the shunt 200 in the direction generally indicated by arrows 203 of FIG. 3, but may further or alternatively be provided by a pin 234 being inserted through the round head 228 (discussed hereinbelow) and then swaged or peened to expand the layers of conductive ribbon 230 of the second end 204 radially outward against the interior arcuate portion 118 of the second aperture 116.

For each of the example shunts 200, the first and second generally rounds heads 226,228 of the first and second ends 202,204 further include first and second pins 232,234 disposed through the center of the heads 226,228 within the first and second apertures 54,116, respectively. More specifically, the layers of conductive ribbon 230 of the shunt 200 wrap around the first and second pins 232,234 within the first and second apertures 54,116, respectively, of the load conductor 52 and the corresponding movable contact arm 110, respectively, as shown in FIG. 3.

In FIG. 2, the first pin 232 is shown before being inserted through the center of the first generally round head 226 of each of the shunts 200 within the interior arcuate portion 56 of the single elongated recess 54 of the load conductor 52. Accordingly, it will be appreciated that the first and second ends 202,204 of the shunts are secured within the first and second apertures 54,116, respectively, of the load conductor 52 and the corresponding movable contact arms 210. This may be accomplished by, for example and without limitation, swaging or crimping a portion (e.g., neck portion 58) of the load conductor 52 adjacent the first aperture 54, and a portion (e.g., neck portion 120) of the corresponding movable contact arm 110 adjacent the second aperture 116 against the first and second ends 202,204 of the shunts 200, respectively, or by any other known or suitable fastening process or mechanism, such as, for example, a rivet 232,234 (e.g., a staked or suitably deformed pin), solder, brazing, or any suitable combination thereof.

As best shown in FIG. 2, the movable contact assembly 100 may further include a plurality of spacers 150 structured to separate the movable contact arms 110 of the assembly 100 from one another. Specifically, each of the spacers 150 includes a first portion 152, a connection portion 154, and a second portion 156 spaced opposite from the first portion 152, as shown. Each of the movable contact arms 110 of the movable contact assembly 100 is disposed between the first and second portions 152,156 of one of the spacers 150, thereby separating one movable contact arm 110 from at least one other movable contact arm 110 of the movable contact assembly 100. The spacers 150 may be made from any known or suitable material, such as, for example and without limitation, vulcanized fiber material, commonly referred to as fish paper. It will be appreciated that the spacers 150 may, but need not necessarily, also serve to electrically and/or thermally insulate the movable contact arms 110 of the assembly 100 from one another.

In addition to the aforementioned flexible conductive members 200, FIG. 2 also shows a contact spring assembly 300 for the movable contact assembly 100 of conductor assembly 50. The movable contact assembly 100, previously discussed, further includes opposing first and second carrier members 102,104 which secure the movable contact arms 110 therebetween, thus comprising a carrier assembly 101. The contact spring assembly 300 is coupled to at least one of the first and second carrier members 102,104, and is disposed between the first and second carrier members 102,104 proximate the second ends 114 of the movable contact arms 110.

Referring to FIGS. 2, 4, 5, 6A, and 6B, the contact spring assembly 300 includes a first contact spring housing member 302 and a second contact spring housing member 304 coupled to the first contact spring housing member 302 and disposed opposite therefrom. A spring guide 306 is coupled to at least one of the first and second contact spring housing members 302,304, and is disposed therebetween. The spring guide 306 includes a plurality of spring holes 308 each structured to receive a corresponding spring 312. Specifically, each spring 312 has a first end 314, which is received by a corresponding one of the spring holes 308 of spring guide 306, and a second end 316, which is coupled to a corresponding slider 310 (best shown in FIGS. 2 and 5). Each of the springs 312 and sliders 310 coupled thereto is structured to individually bias a corresponding one of the movable contact arms 110 (FIGS. 1-4) of the movable contact assembly 100 (FIGS. 1-4) and the movable electrical contact 130 (FIGS. 1-3) coupled thereto towards engagement with a corresponding one of the stationary electrical contacts 12 (FIG. 3) of the stationary contact assembly 10 (FIG. 3).

The example first and second contact spring housing members 302,304 are substantially identical. Thus, the number of components which must be manufactured for the contact spring assembly 300 is reduced, thereby reducing the associated manufacturing costs. Additionally, the substantially identical first and second contact spring housing members 302,304 enable the contact spring assembly 300 to be secured together without requiring the use of conventional mechanical fasteners (e.g., without limitation, screws; rivets; bolts and nuts), as will be discussed in greater detail herein below.

Figure 4:
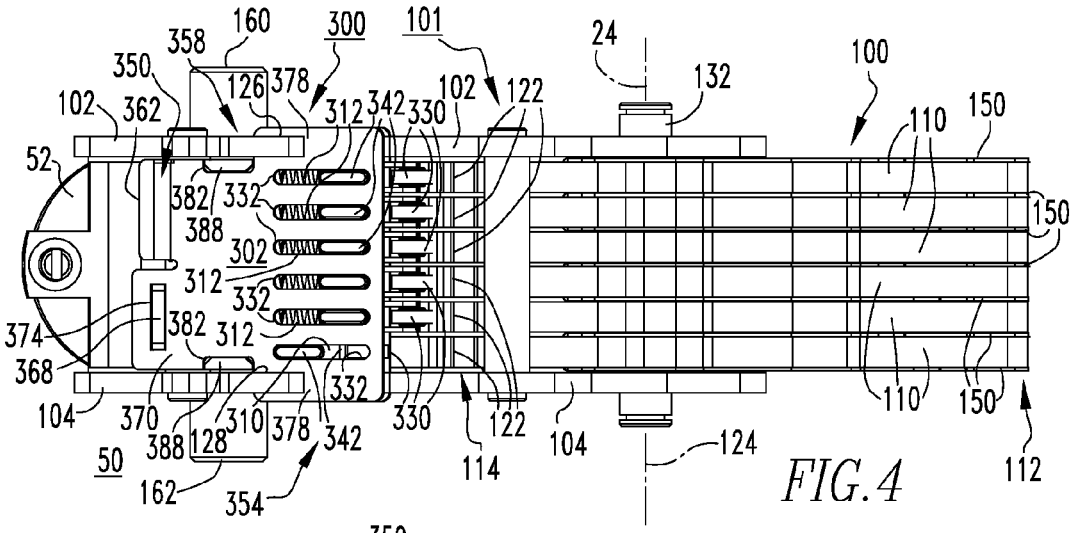
FIG. 4 is a top plan view of the conductor assembly of FIG. 1, including a contact spring assembly.
Figure 5:
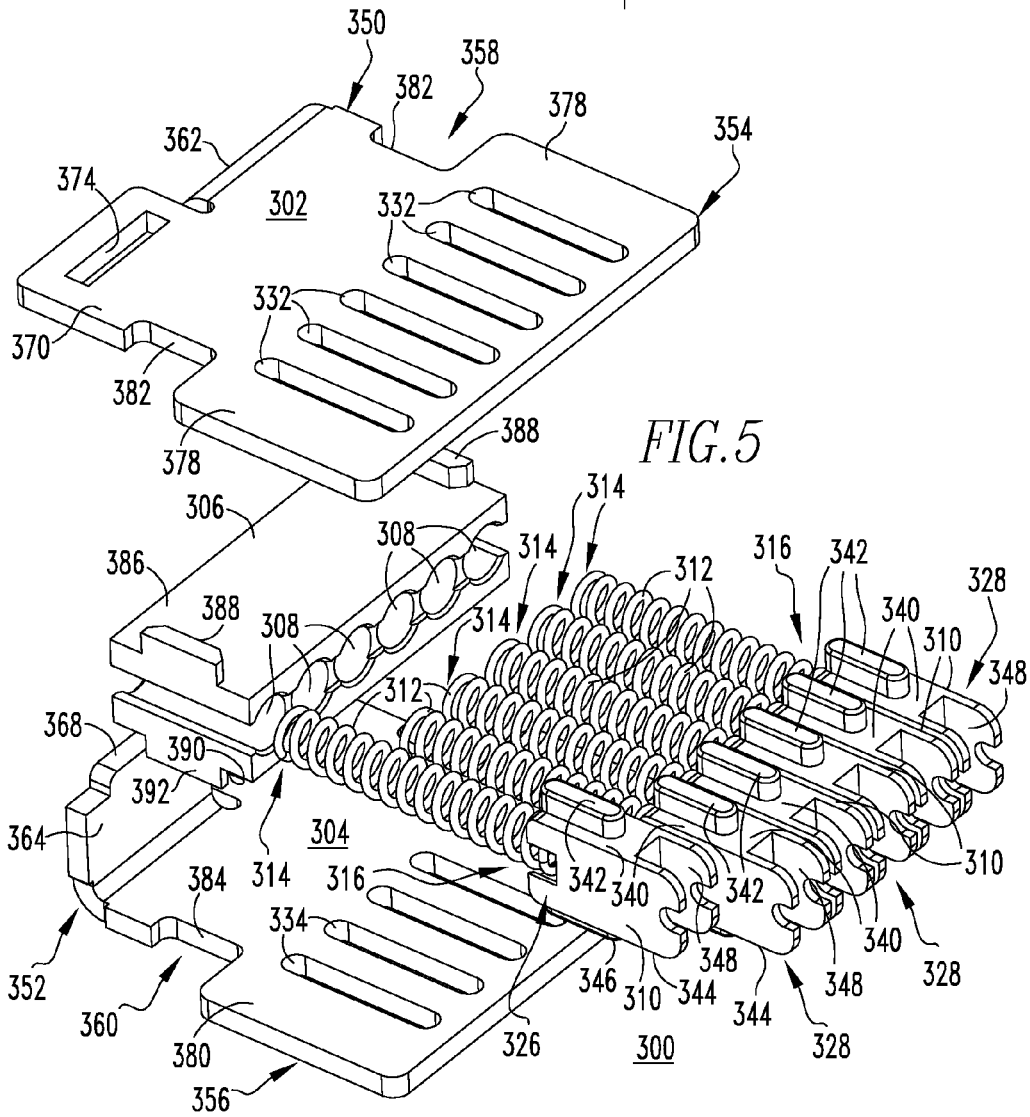
FIG. 5 is an exploded isometric view of the contact spring assembly of FIG. 4.

As shown in FIGS. 2 and 5, the example contact spring assembly 300 includes six springs 312 which are received in six corresponding spring thru holes 308 of the spring guide 306. The thru holes 308 (best shown in FIG. 5) extend completely through the spring guide 306, in order to receive the first ends 314 of the springs 312. As previously discussed, the second ends 316 of the springs 312 are coupled to individual sliders 310. Each slider 310 includes a first end 326 coupled to the second end 316 of a corresponding one of the springs 312, and a second end 328 comprising a cam element such as the rollers 330, best shown in FIGS. 2 and 4. Each of the cam elements 330 (FIGS. 2 and 4) is structured to engage and move a corresponding one of the movable contact arms 110 of the movable contact assembly 100.

Figure 6A:
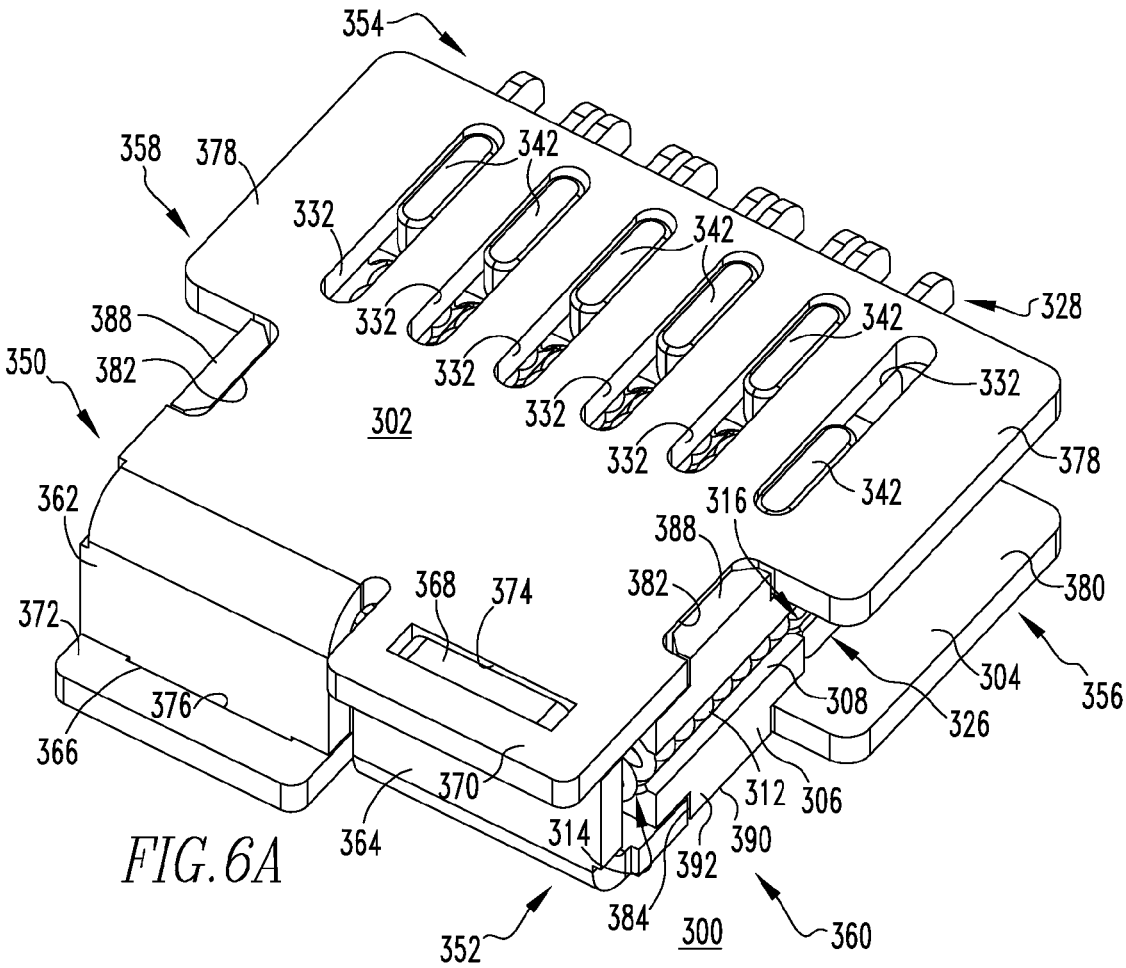
FIG. 6A is an assembled top isometric view of the contact spring assembly of FIG. 5.
Figure 6B:
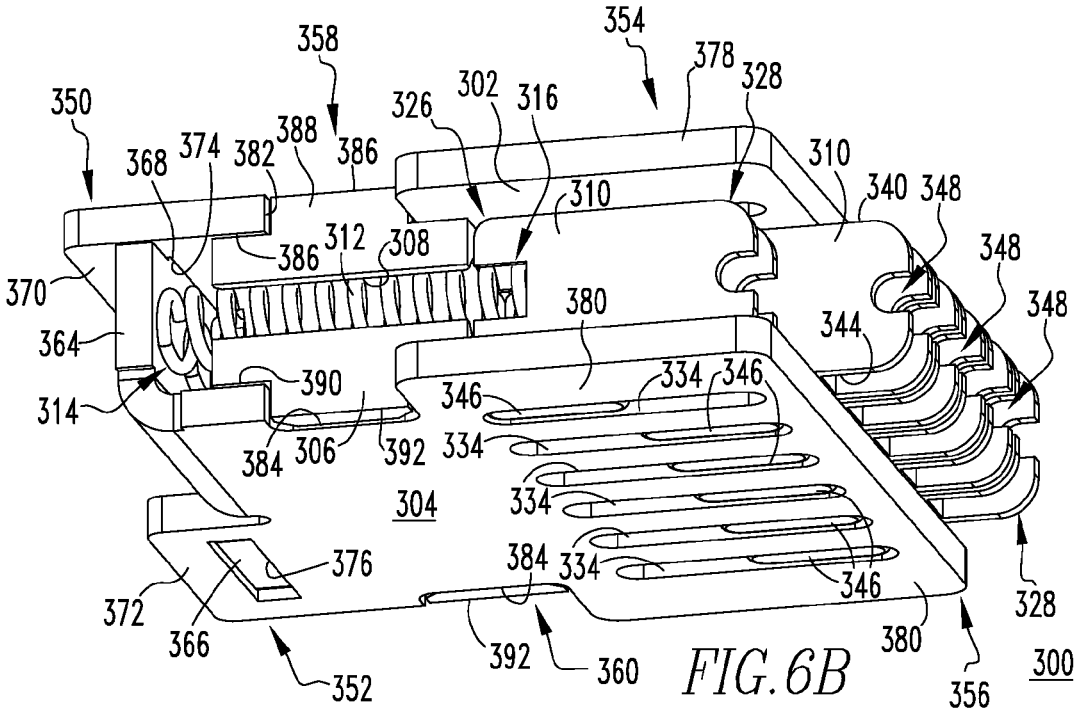
FIG. 6B is an assembled bottom isometric view of the contact spring assembly of FIG. 5.

Referring to FIGS. 5, 6A and 6B, the first and second contact spring housing members 302,304 of the contact spring assembly 300 each include a plurality of elongated guide slots 332,334 for receiving first and second protrusions 342,346 on the first and second sides 340,344 of each slider 310. Specifically, the first and second protrusions 342,346 engage an opposing pair of the elongated guide slots 332,334 of the first and second spring housing members 302,304, respectively, in order to guide the slider 310 and cam element 330 (FIGS. 2 and 4) towards engagement with the corresponding movable contact arm 110 (FIGS. 2 and 4). For example, in FIG. 4, five of the cam elements 330 are extended and engaging the second ends 114 of corresponding movable contact arms 110 of the movable contact assembly 100. The sixth cam element 330 is retracted, as indicated by the position of the first protrusion 342 of slider 310 within the first guide slot 332 of the first contact spring housing member 302. Accordingly, it will be appreciated that the cam elements 330 (FIGS. 2 and 4) of the contact spring assembly 300 in accordance with embodiments of the invention individually engage and bias a corresponding movable contact arm 110 (FIGS. 2 and 4) independent from the remainder of the cam elements 330 (FIGS. 2 and 4) of the contact spring assembly 300. It will be appreciated that the cam elements 330 can comprise any known or suitable bearing element, such as the small wheel 330 shown in FIG. 2, which is pivotably disposed within a recess 348 at the second end 328 of slider 310.

As previously noted, the contact spring assembly 300 is secured together and to the carrier assembly 101 (FIG. 2), without requiring the use of separate mechanical fasteners. More specifically, as best shown in FIGS. 5, 6A and 6B, the first and second contact spring housing members 302,304 each include at least one protrusion 366,368 and at least one aperture 374,376, wherein the first and second contact spring housing members 302,304 are positioned in order that the protrusion 366,368 of one of the first and second contact spring carrier members 302,304 engages the aperture 374, 376 of the other of the first and second contact spring carrier member 302,304, respectively, thereby securing the contact spring assembly 300 together. More specifically, the first and second contact spring housing members 302,304 each include a first end 350,352 and a second end 354,356, respectively. The first end 350,352 includes a folded tab 362,364 including the protrusion 366,368, and an unfolded tab 370, 372 having the aperture 374,376. The relationship between the first and second contact spring housing members 302,304 which, as previously discussed, are substantially identical, can best be appreciated with reference to the front and back isometric views of the contact spring assembly 300 shown in FIGS. 6A and 6B, respectively. Specifically, protrusion 366 of the folded tab 362 of the first end 350 of first contact spring housing member 302 engages the aperture 376 of the unfolded tab 372 of the first end 352 of second contact spring housing member 304, and protrusion 368 of the folded tab 364 of the first end 352 of second contact spring housing member 304 engages the aperture 374 of the unfolded tab 370 of the first end 350 of first contact spring housing member 302.

The second ends 354,356 of the first and second contact spring housing members 302,304 each comprise a pair of lateral protrusions 378,380 which, as best shown in FIGS. 2 and 4, are structured to engage corresponding slots 126,128 in the first and second carrier members 102,104 of the carrier assembly 101 of movable contact assembly 100. More specifically, the pair of lateral protrusions 378,380 of the second end 354,356 of one of the first and second contact spring housing members 302,304 engages corresponding slots 126, 128 in the first and second carrier members 102,104, respectively, of the carrier assembly 101, thereby securely coupling the contact spring assembly 300 to the movable contact assembly 100, without the use of separate mechanical fasteners.

The first and second contact spring housing members 302, 304 also include an intermediate portion 358,360 having a pair of recesses 382,384, respectively. The recesses 382,384 are engaged by corresponding first and second pairs of protrusions 388,392 on the first and second sides 386,390, respectively, of the spring guide 306.

As shown in FIGS. 1, 2, and 4, the movable contact arms 110 of the movable contact assembly 100 have an axis of a rotation 124. The axis of a rotation 124 extends generally perpendicularly with respect to the first and second carrier members 102,104 of the carrier assembly 101. More specifically, the movable contact arms 110 pivot clockwise and counterclockwise (from the perspective of FIGS. I and 2) about a pivot pin 132, which extends through a corresponding aperture 134 (FIG. 2) in each of the movable contact arms 110. The contact spring assembly 300 is coupled to the movable contact assembly 100, in the manner previously discussed, at a location which is above and behind the axis of rotation 124. This location, which is proximate the second ends 114 of the movable contact arms 110 of the movable contact assembly 100, provides the springs 312 of the contact spring assembly 300 with a mechanical advantage by placing them at a location (e.g., above and behind) which facilitates pivotal movement of the movable contact arms 110 about the aforementioned axis of a rotation 124. More specifically, the second end 114 of each movable contact arm 110 includes a cam profile 122 (FIGS. 2-4). In operation, the roller cam element 330 (FIGS. 2-4) of each slider 310 (FIGS. 2, 4, 5, 6A and 6B) of the contact spring assembly 300 (FIGS. 1, 2, 4, 5, 6A and 6B) engages the cam profile 122 of a corresponding one of the movable contact arms 110. In turn, as shown in FIG. 3, the roller cam element 330 (shown in phantom line drawing in simplified form in FIG. 3) rolls along the cam profile 122 in the direction generally indicated by arrow 136 of FIG. 3 as it biases the second end 114 of the movable contact arm 110 in the direction generally indicated by arrow 138 of FIG. 3, causing the movable contact arm 110 to pivot clockwise (from the perspective of FIG. 3) about axis of rotation 124 as generally indicated by arrow 140 of FIG. 3. In this manner, movable electrical contact 130 of the movable contact arm 110 is pivoted toward electrical contact with stationary electrical contact 12 of the stationary contact assembly 10. It will be appreciated that the cam profile 122 could have any known or suitable shape in order to provide the desired movable contact arm 110 motion.

The example stationary contact assembly 10, which is shown in phantom line drawing in simplified form in FIG. 3, includes a first contact portion 14 which is engaged by movable electrical contact 130 on movable contact arm 110, as shown. It will, however, be appreciated that the stationary contact assembly 10 could have any known or suitable alternative configuration. For example and without limitation, it could further include a second contact portion 16, as shown in phantom line drawing in simplified form in FIG. 3. It will also be appreciated that the first end 112 of the movable contact arm 110 could include, for example, a toe portion 106 and a heel portion 108, with the movable electrical contact 130 being mounted on the heel portion 108, as shown. The movable electrical contact 130 at or about the heel portion 108 is movable into and out of electrical contact with the stationary electrical contact 12 of first contact portion 14 of the stationary contact assembly 10, and the toe portion 106 is movable into (not shown) and out of (as shown) electrical contact with the second contact portion 16 of the stationary contact assembly 10. This movable and stationary electrical contact interaction is commonly referred to in the art as a "heel-toe" contact configuration, and is generally well known. Thus, the contact spring assembly 300 facilitates movement of the movable contact assembly 100 which is controlled by the circuit breaker operating mechanism (shown in simplified form in FIG. 1), in any suitable well known manner.

Referring to FIGS. 1 and 7-11, a pivot assembly 400 for the carrier assemblies 101 (FIGS. 1 and 9) of the low-voltage circuit breaker 2 (FIGS. 1, 9 and 10) is shown. The pivot assembly 400 comprises a plurality of pivot members 402, 404 which are separate independent components from the circuit breaker housing 3 (FIGS. 1 and 9-11). The pivot member 402,404 are structured to be clam-shelled between the molded cover 4 (FIGS. 1 and 9-10) and the molded base 5 (FIGS. 1, 9 and 10) of the circuit breaker housing 3, in order to improve the accuracy with which the carrier assembly 101 and components thereof (e.g., without limitation, movable contact assembly 100) are mounted within the circuit breaker 2.

Figure 9:
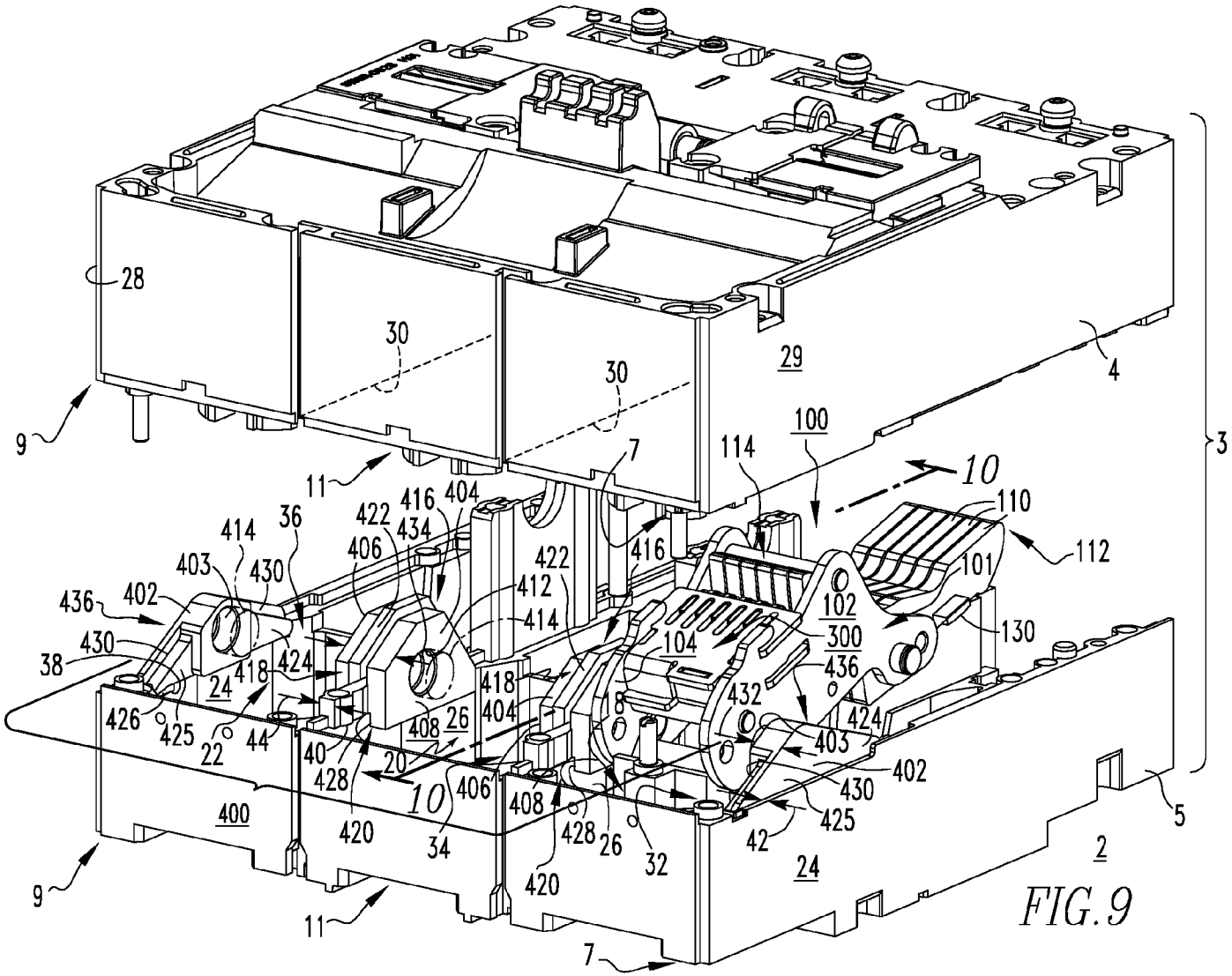
FIG. 9 is a partially assembled isometric view of the low-voltage circuit breaker of FIG. 1.

As best shown in FIG. 9, each of the pivot members 402, 404 includes an aperture 403,408,412 structured to receive a suitable pivot 158 of the carrier assembly 101 (FIG. 2) in order that it is pivotably coupled between a corresponding pair of the pivot members, such as 402,404, as shown. The pivot 158 may comprise any suitable pivot such as, for example and without limitation, at least one pivot pin, such as the first and second pivot pins 160,162 extending outwardly, generally perpendicularly from the first and second carrier members 102,104 of the carrier assembly 101 in FIG. 4.

Figure 7:
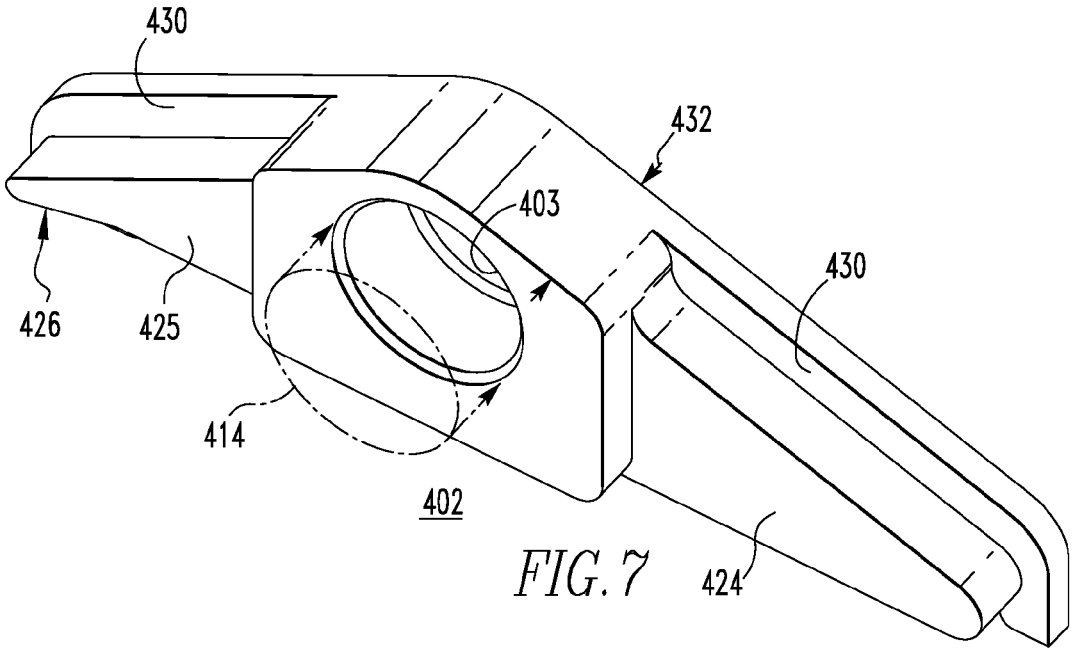
FIG. 7 is an isometric view of one component of the independent pivot assembly of FIG. 1.
Figure 8:
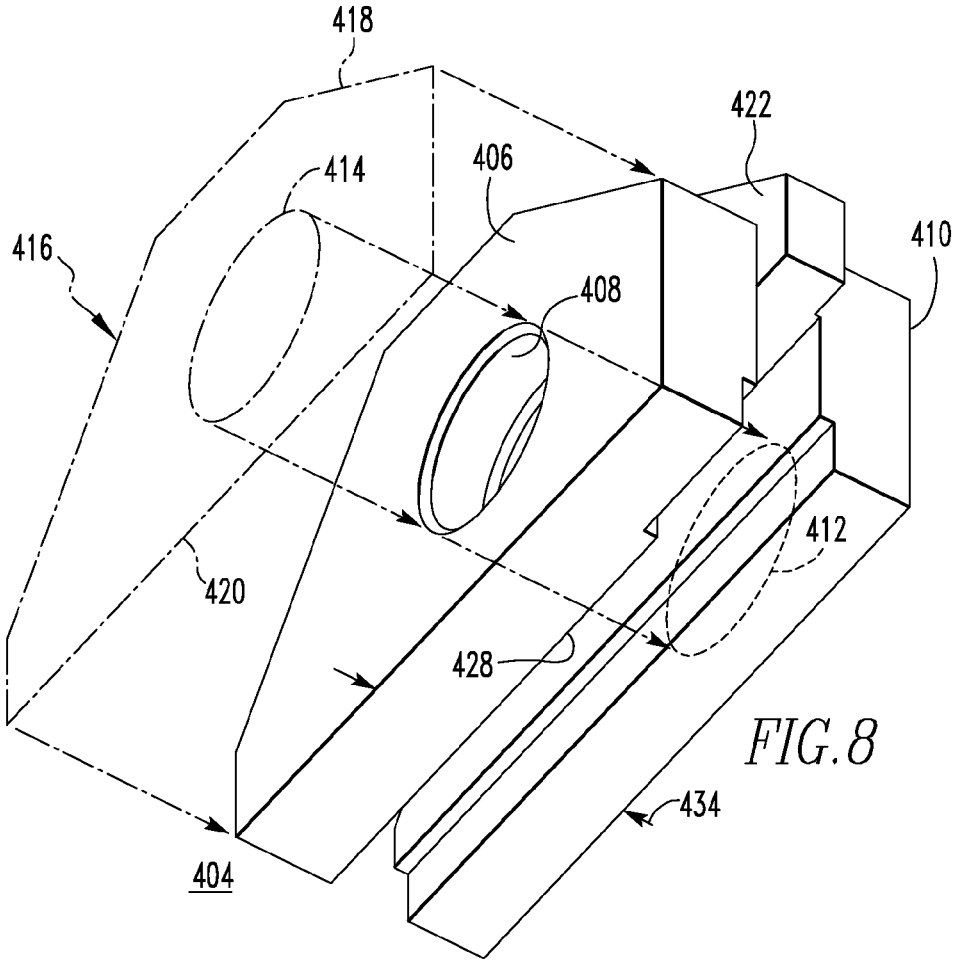
FIG. 8 is an isometric view of another component of the independent pivot assembly of FIG. 1.
Figure 10:
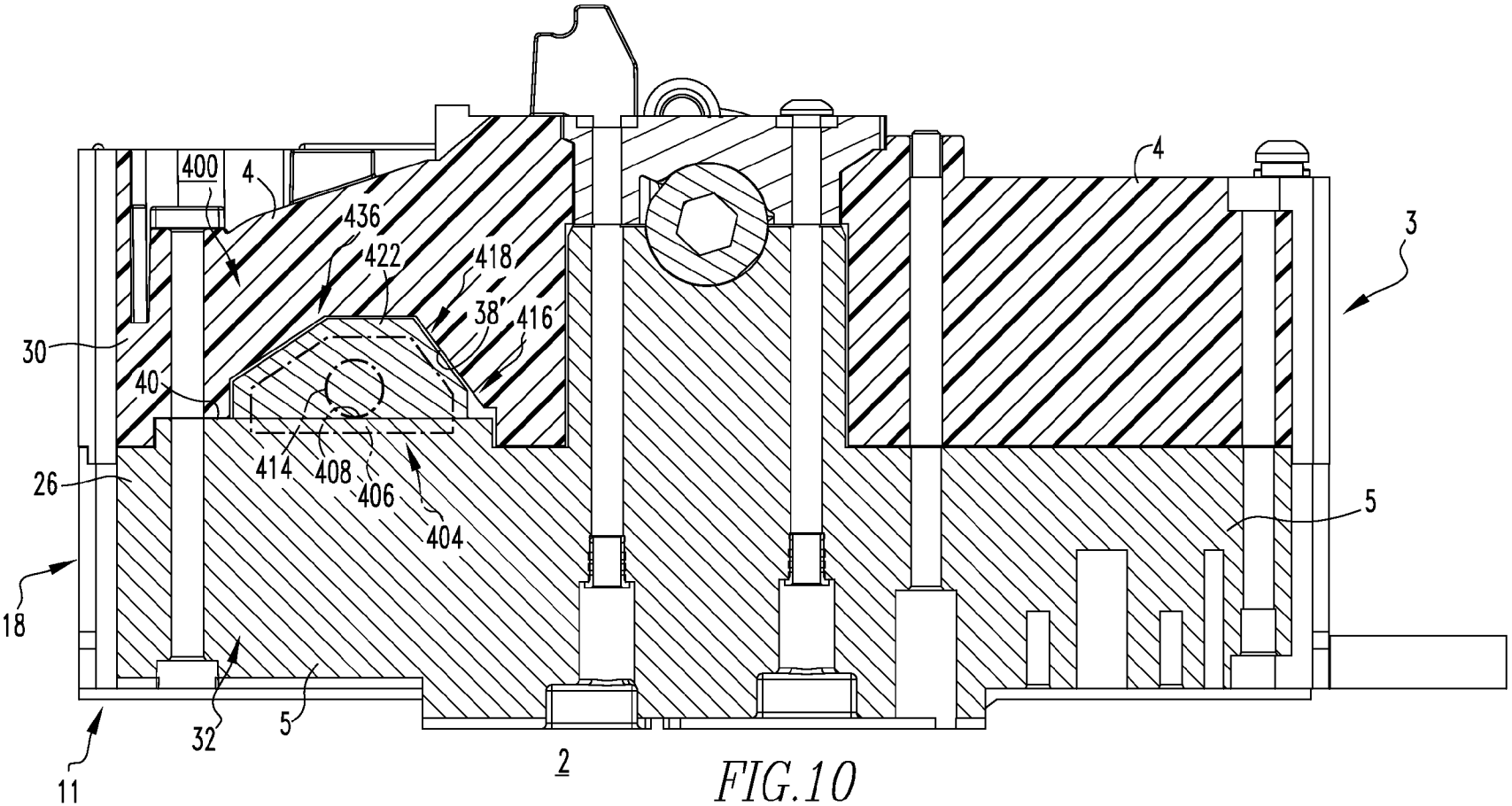
FIG. 10 is a cross-sectional view taken along line 10-10 of FIG. 9, modified to show the low-voltage circuit breaker assembled.

FIGS. 7 and 8 respectively show the two types of pivot members 402 and 404 which comprise the example pivot assembly 400 (FIGS. 1, 9 and 10). More specifically, each of the one-piece molded pivot members 402,404 includes the aperture 403 (FIG. 7), 408 (FIG. 8), 412 (shown in hidden line drawing in FIGS. 8 and 10; see also FIG. 9) which is a substantially circular pivot recess 403 (FIG. 7), 408 (FIG. 8), 412 (shown in hidden line drawing in FIGS. 8 and 10; see also FIG. 9) having a full, continuous circumference 414. In this manner, in accordance with embodiments of the invention, the pivot members 402,404 address and overcome the aforementioned disadvantages associated with misalignment between the molded semi-circles which form the pivot recess of some known carrier assembly pivots.

End pivot member 402 of FIG. 7 includes a pair of lateral extensions 424,425 which extend outwardly from the pivot recess 403. In the example shown and described herein, at least one of the lateral extensions 424,425 includes at least one protrusion, such as the single tab 426 (best shown in FIG. 7) extending generally perpendicularly from lateral extension 425 of the pivot member 402. Each of the end pivot members 402 in the example shown and described, also includes at least one cut-out portion, such as, for example and without limitation, the pair of cut-out portions 430 in each of the lateral extensions 424,425 of the example end pivot member 402, shown. Each end pivot member 402 also has a width 432 which, as will be discussed hereinbelow, is equal to or greater than the width of the walls 24,26,28,30 (FIGS. 1 and 9) of the circuit breaker housing 3 (FIG. 1, and FIGS. 9-11). It will, however, be appreciated that the end pivot members 402 of the pivot assembly 400 (FIGS. 1, 9, and 10) could comprise any known or suitable alternative configuration and number of recesses and protrusions other than those shown and described herein, without departing from the scope of the invention. For example and without limitation, the pivot members 402 could alternatively have a combination (not shown) of protrusions but no recesses, or a combination (not shown) of recesses but no protrusions.

FIG. 8 shows an intermediate pivot member 404 of the pivot assembly 400 (FIGS. 1, 9, and 10). Each of the intermediate pivot members 404 has a perimeter 416 with at least one protrusion such as, for example, rib 422, which extends outwardly from a first portion 418 of the perimeter 416, and at least one recess such as, for example, elongated recess 428, within a second portion 420 of the perimeter 416. The rib 422 and elongated recess 428, like the aforementioned tab 426 and cut-out portions 430 of end pivot member 402 discussed in connection with FIG. 7, function to secure the pivot member 404 between the molded cover 4 and molded base 5 of the circuit breaker housing 3, as will be discussed in greater detail hereinbelow, for example with respect to FIG. 10. Like end pivot member 402, intermediate pivot member 404 is a one-piece molded member having a first pivot recess 408 in the first side 406 thereof, wherein the first pivot recess 408 has a full, continuous diameter 414. However, unlike end pivot member 402, each of the intermediate pivot members 404 further includes a second side 410 having a second pivot recess 412 (see, for example, FIG. 9). In this manner, in operation, each intermediate pivot member 404 receives and pivotably secures the pivot members 158 (FIG. 1) of two different carrier assemblies 101 (one carrier assembly 101 is shown in FIG. 1, for ease of illustration), one on the first side 406 and the other on the second side 410 of the intermediate pivot member 404.

At least one of the protrusions 422,426 of the respective pivot members 404,402 is structured to engage one of the molded cover 4 and the molded base 5 of the circuit breaker housing 3, and at least one of the cut-out portions 428,430 of the respective pivot members 404,402 is structured to engage the other of the molded cover 4 and molded base 5 in order to clam-shell the pivot members 402,404 therebetween, as previously discussed.

As employed herein, the term "clam-shell" refer to the nature in which the pivot members 402,404 are secured (e.g., sandwiched) between the molded cover 4 and molded base 5 of the circuit breaker housing 3, without requiring the use of separate fasteners. More specifically, as shown in FIG. 9, the circuit breaker 2 has a plurality of poles 18,20,22, and includes a carrier assembly 101 for each of these poles (one carrier assembly 101 is shown for simplicity of illustration). The circuit breaker housing 3 comprises a plurality of substantially vertical walls 24,26 and 28,30 molded in the molded base 5 and molded cover 4, respectively, of the circuit breaker housing 3. When the molded cover 4 and molded base 5 are assembled, as shown in FIG. 10, each of the substantially vertically walls 24,26 of the molded base 5 generally aligns with a corresponding one of the substantially vertical walls 28,30 of the molded cover 4 to form a plurality of separate cavities 32,34,36 for the poles 18,20,22 of the circuit breaker 2. Each of the aforementioned pivot members 402, 404 of the pivot assembly 400 is clam-shelled between the corresponding pair of substantially vertical walls 24,26 of the molded base 5 and the substantially vertical walls 28,30 of the molded cover 4, thereby providing substantially unobstructed access to the separate cavities 32,34,36 within the circuit breaker housing 3. In this manner, the pivot assembly 400 enables a circuit breaker housing 3 to accommodate a wide variety of circuit breaker component designs. For example and without limitation, it is the clam-shelled pivot assembly design which, in large part, enables the use of the solid conductor 52 of the conductor assembly 50, previously discussed in connection with FIGS. 1-3, and provides space to receive additional components such as, for example and without limitation, a sensor (not shown).

Figure 11:
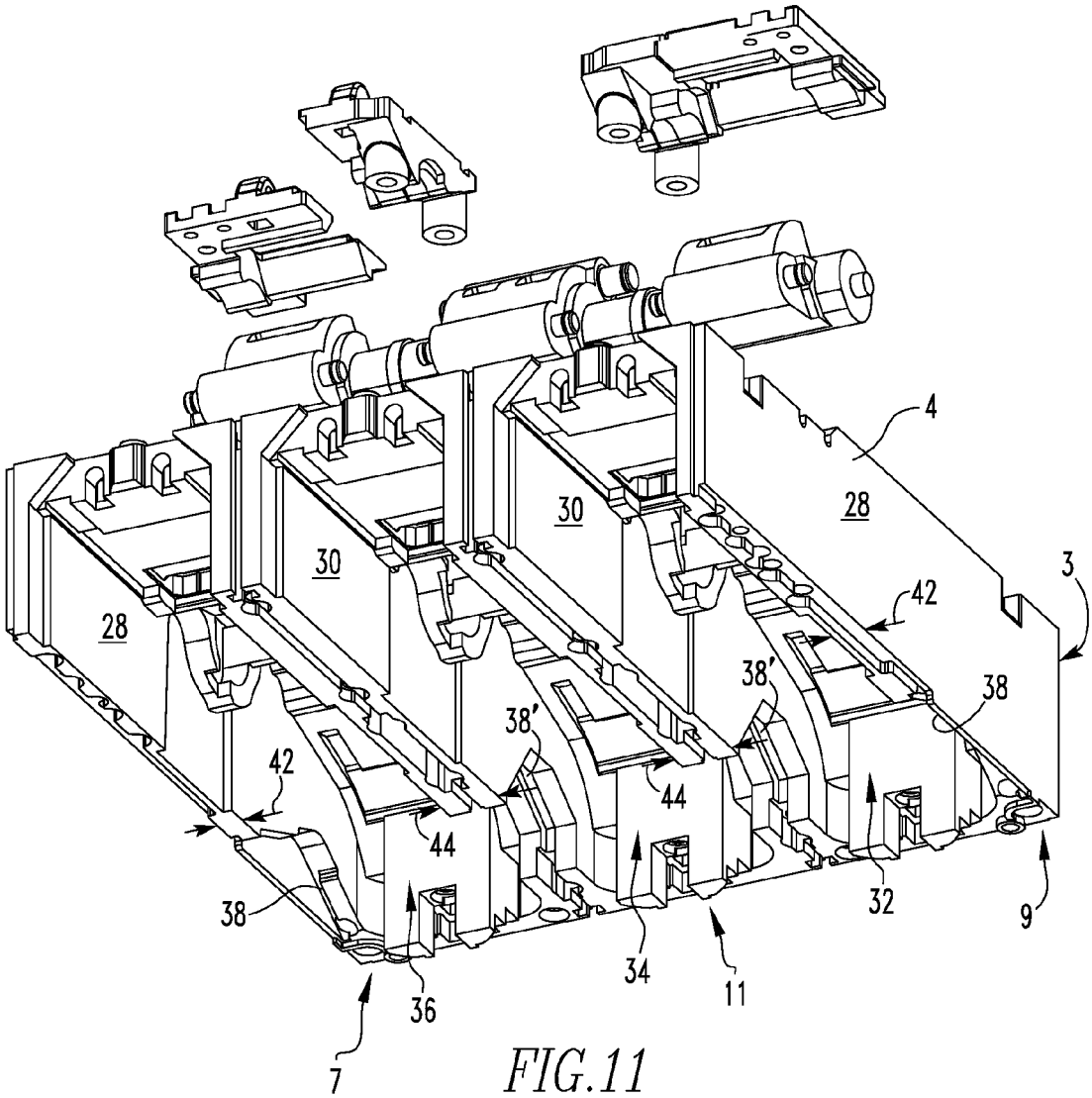
FIG. 11 is an isometric view of the underside of the molded cover of the low-voltage circuit breaker of FIG. 1.

Continuing to refer to FIG. 9, the pivot assembly 400 for the three-pole low-voltage circuit 2 includes four pivot members 402,404, a pair of the aforementioned end pivot members 402 disposed at or about the first and second sides 7,9 of the circuit breaker housing 3, and a pair of the aforementioned intermediate pivot members 404 disposed between the end pivot members 402 at an intermediate portion 11 of the circuit breaker housing 3, as shown. More specifically, the tab 426 of each end pivot member 402 engages a corresponding recess 38 (best shown in FIGS. 1 and 9) of the molded base 5 of the circuit breaker housing 3 and the cut-out portions 430 and lateral extensions 424,425 of each end pivot member 402 are received within a corresponding recess 38 in the molded cover 4 of the circuit breaker housing 3, as best shown in FIG. 11, to clam-shell the end pivot members 402 between the molded cover 4 and molded base 5 of the circuit breaker housing 3, as previously discussed. Each intermediate pivot member 404 is similarly clam-shelled by the rib 422 of the intermediate pivot member 404 engaging a corresponding recess 38' of the molded cover 4 of the circuit breaker housing 3, as best shown in FIGS. 10 and 11, and the elongated recess 428 of the intermediate pivot member 404 receiving the corresponding protrusion 40 (e.g., without limitation, portion 40 of substantially vertical wall 26) of the molded base 5 of the circuit breaker housing 3.

In addition to the aforementioned advantages (e.g., without limitation, accommodation of manufacturing tolerance discrepancies; improved alignment between circuit breaker components), the pivot members 402,404 of the pivot assembly 400 also serve to provide a superior dielectric barrier 436 (FIGS. 9 and 10) between poles 18,20,22 (FIG. 9) of the circuit breaker 2, in order to electrically isolate one pole 18,20,22 from another. This advantage is afforded both by the aforementioned protrusion (e.g., rib 422) and recess (e.g., recess 38') closely fitting clam-shelled structure of the pivot assembly 400, which can best be appreciated with reference to the cross-sectional view of FIG. 10, and also to the fact that the first widths 432 (best shown in FIG. 7), 434 (best shown in FIG. 8) of the end pivot members 402 and intermediate pivot members 404 are greater than the second widths 42,44 (FIG. 9) of the walls 24,26 (FIG. 9), respectively, of the circuit breaker housing 3 (FIG. 9). Thus, it will be appreciated that the pivot members 402 are separate pieces, the increased widths 432,434 of which provide superior mechanical bearing support while simultaneously permitting widths 42,44 of the walls 24,26, for example, to be thinner, thereby providing increased interior space.

Accordingly, the pivot assembly 400 provides a robust, cost effective design which improves the accuracy with which circuit breaker components such as, for example and without limitation, the carrier assemblies 101 of the circuit breaker 2, are mounted within the circuit breaker housing 3.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A pivot assembly for an electrical switching apparatus including a housing having a molded cover and a molded base, a stationary contact assembly, and a movable contact assembly, said movable contact assembly including at least one carrier assembly, and being movable into and out of electrical contact with said stationary contact assembly, said at least one carrier assembly including a pivot, said pivot assembly comprising:

a plurality of pivot members, each of said pivot members including a substantially circular aperture structured to pivotably receive said pivot of said at least one carrier assembly in order that said pivot pivots with respect to said pivot members and said at least one carrier assembly is pivotably coupled between a corresponding pair of said pivot members, without a separate bearing element, wherein each of said pivot members is a separate independent component structured to be disposed between said molded cover of said housing of said electrical switching apparatus and said molded base of said housing of said electrical switching apparatus.

2. The pivot assembly of claim 1 wherein said pivot of said at least one carrier assembly comprises at least one pivot pin; wherein the substantially circular aperture of each of said pivot members comprises a substantially circular pivot recess having a full, continuous circumference; and wherein said substantially circular pivot recess is structured to receive a corresponding one of said at least one pivot pin of said at least one carrier assembly.

3. The pivot assembly of claim 1 wherein said at least one carrier assembly of said electrical switching apparatus comprises a plurality of carrier assemblies; wherein said pivot members comprise a pair of end pivot members and a number of intermediate pivot members disposed between said pair of end pivot members; and wherein each of said carrier assemblies is pivotably coupled to and disposed between: (a) one of said intermediate pivot members, and (b) another one of said intermediate pivot members or one of said pair of end pivot members.

4. The pivot assembly of claim 3 wherein said pivot of each of said carrier assemblies comprises at least one pivot pin; wherein each of said intermediate pivot members has a first side including a first pivot recess structured to pivotably receive said at least one pivot pin of one of said carrier assemblies of said electrical switching apparatus, and a second side having a second pivot recess structured to pivotably receive said at least one pivot pin of another one of said carrier assemblies of said electrical switching apparatus.

5. A pivot assembly for an electrical switching apparatus including a housing having a molded cover and a molded base, a stationary contact assembly, and a movable contact assembly, said movable contact assembly including at least one carrier assembly, and being movable into and out of electrical contact with said stationary contact assembly, said at least one carrier assembly including a pivot, said pivot assembly comprising:

a plurality of pivot members, each of said pivot members including an aperture structured to pivotably receive said pivot of said at least one carrier assembly in order that said at least one carrier assembly is pivotably coupled between a corresponding pair of said pivot members, wherein each of said pivot members is a separate independent component structured to be disposed between said molded cover of said housing of said electrical switching apparatus and said molded base of said housing of said electrical switching apparatus, and wherein each of said pivot members comprises at least one protrusion and at least one cut-out portion; wherein said at least one protrusion is structured to engage one of said molded cover of said housing of said electrical switching apparatus and said molded base of said housing of said electrical switching apparatus; and wherein said at least one cut-out portion is structured to engage the other one of said molded cover and said molded base in order to secure said pivot members therebetween, without requiring the use of separate fasteners.

6. The pivot assembly of claim 5 wherein at least one of said pivot members further comprises a perimeter; wherein said at least one protrusion of said at least one of said pivot members is a rib extending substantially vertically from a first portion of said perimeter; and wherein said cut-out portion of said at least one of said pivot members is an elongated recess in a second portion of said perimeter.

7. The pivot assembly of claim 5 wherein at least one of said pivot members further comprises a pair of lateral extensions extending outwardly from the aperture of said at least one of said pivot members; wherein said at least one protrusion of said at least one of said pivot members is at least one tab extending from at least one of said pair of lateral extensions; and wherein said cut-out portion of said at least one of said pivot members is a cut-out portion of at least one of said pair of lateral extensions.

8. The pivot assembly of claim 1 wherein each of said pivot members is a one-piece molded member.

9. A carrier assembly for an electrical switching apparatus including a housing having a molded cover and a molded base, a stationary contact assembly having a plurality of stationary electrical contacts, and a movable contact assembly, said carrier assembly comprising:

a first carrier member;

a second carrier member;

a plurality of movable contact arms pivotably coupled between said first carrier member and said second carrier member;

a plurality of movable electrical contacts coupled to said movable contact arms and being structured to be movable into and out of electrical contact with said stationary electrical contacts of said stationary contact assembly;

a pivot extending outwardly from said first carrier member of said carrier assembly and said second carrier member of said carrier assembly; and a pivot assembly comprising:

a pair of pivot members, each of said pivot members including a substantially circular aperture pivotably receiving said pivot of said carrier assembly in order that said pivot pivots with respect to said pivot members and said carrier assembly is pivotably coupled therebetween, without a separate bearing element, wherein each of said pair pivot members is a separate independent component structured to be disposed between said molded cover of said housing of said electrical switching apparatus and said molded base of said housing of said electrical switching apparatus.

10. The carrier assembly of claim 9 wherein said pivot of said carrier assembly comprises at least one pivot pin extending generally perpendicularly from said first carrier member and from said second carrier member; wherein each of said pivot members comprises a one-piece molded member; wherein the substantially circular aperture of said one-piece molded member of each of said pivot members comprises a substantially circular pivot recess having a full, continuous circumference; and wherein said substantially circular pivot recess receives a corresponding one of said at least one pivot pin of said carrier assembly.

11. A carrier assembly for an electrical switching apparatus including a housing having a molded cover and a molded base, a stationary contact assembly having a plurality of stationary electrical contacts, and a movable contact assembly, said carrier assembly comprising:

a first carrier member;

a second carrier member;

a plurality of movable contact arms pivotably coupled between said first carrier member and said second carrier member;

a plurality of movable electrical contacts coupled to said movable contact arms and being structured to be movable into and out of electrical contact with said stationary electrical contacts of said stationary contact assembly;

a pivot extending outwardly from said first carrier member of said carrier assembly and said second carrier member of said carrier assembly; and a pivot assembly comprising:

a pair of pivot members, each of said pivot members including an aperture pivotably receiving said pivot of said carrier assembly in order that said carrier assembly is pivotably coupled therebetween, wherein each of said pair pivot members is a separate independent component structured to be disposed between said molded cover of said housing of said electrical switching apparatus and said molded base of said housing of said electrical switching apparatus, and wherein each of said pivot members of said pivot assembly comprises at least one protrusion and at least one cut-out portion; wherein said at least one protrusion is structured to engage one of said molded cover of said housing of said electrical switching apparatus and said molded base of said housing of said electrical switching apparatus; and wherein said at least one cut-out portion is structured to engage the other of said molded cover and said molded base in order to secure said pivot member therebetween, without requiring the use of separate fasteners.

12. The carrier assembly of claim 11 wherein at least one of said pivot members further comprises a perimeter; wherein said at least one protrusion of said at least one pivot member is a rib extending substantially vertically from a first portion of said perimeter; and wherein said cut-out portion of said at least one pivot member is an elongated recess in a second portion of said perimeter.

13. The carrier assembly of claim 11 wherein at least one of said pivot members further comprises a pair of lateral extensions extending outwardly from the aperture of said at least one of said pivot members; wherein said at least one protrusion of said at least one of said pivot members comprises at least one tab extending from at least one of said pair of lateral extensions; and wherein said cut-out portion of said at least one of said pivot members comprises a cut-out portion of at least one of said pair of lateral extensions.

14. An electrical switching apparatus comprising:

a housing including a molded cover and a molded base;

a stationary contact assembly having a plurality of stationary electrical contacts; and a movable contact assembly including at least one carrier assembly, each of said at least one carrier assembly comprising:

a first carrier member, a second carrier member, a plurality of movable contact arms pivotably coupled between said first carrier member and said second carrier member, a plurality of movable electrical contacts coupled to said movable contact arms and being movable into and out of electrical contact with said stationary electrical contacts of said stationary contact assembly, a pivot extending outwardly from said first carrier member and said second carrier member, and a pivot assembly comprising:

a plurality of pivot members, each of said pivot members including a substantially circular pivotably receiving said pivot of a corresponding one of said at least one carrier assembly in order that said pivot pivots with respect to said pivot members and said corresponding one of said at least one carrier assembly is pivotably coupled between a pair of said pivot members, without a separate bearing element, wherein each of said pivot members of said pivot assembly is a separate independent component disposed between said molded cover of said housing of said electrical switching apparatus and said molded base of said housing of said electrical switching apparatus.

15. The electrical switching apparatus of claim 14 wherein said electrical switching apparatus is a circuit breaker having a plurality of poles; wherein said at least one carrier assembly comprises a plurality of carrier assemblies for the poles of said circuit breaker; wherein said housing of said circuit breaker comprises a plurality of substantially vertical walls molded in said molded cover of said circuit breaker housing and in said molded base of said circuit breaker housing, respectively; wherein when said molded cover of said circuit breaker housing and said molded base of said circuit breaker housing are assembled, each of said substantially vertical walls of said molded cover generally aligns with a corresponding one said substantially vertical walls of said molded base to form a plurality of separate cavities for the poles of said circuit breaker; and wherein each of said pivot members of said pivot assembly is clam-shelled between a corresponding pair of said substantially vertical walls of said molded cover and said substantially vertical walls of said molded base, thereby providing substantially unobstructed access to said separate cavities.

16. The electrical switching apparatus of claim 15 wherein said pivot of each of said carrier assemblies comprises at least one pivot pin; wherein said pivot members of said pivot assembly comprise a pair of end pivot members and a number of intermediate pivot members disposed between said pair of end pivot members; and wherein each of said intermediate pivot members of said pivot assembly has a first side including a first pivot recess pivotably receiving said at least one pivot pin of one of said carrier assemblies, and a second pivot recess pivotably receiving said at least one pivot pin of another of said carrier assemblies.

17. The electrical switching apparatus of claim 16 wherein said circuit breaker housing further comprises a first side, a second side disposed generally opposite and distal from the first side, and an intermediate portion disposed between the first side of said circuit breaker housing and the second side of said circuit breaker housing; wherein said pivot members of said pair of end pivot members are clam-shelled between corresponding pairs of said substantially vertical walls of said molded cover of said circuit breaker housing and said substantially vertical walls of said molded base of said circuit breaker housing at or about the first side of said circuit breaker housing and the second side of said circuit breaker housing, respectively; and wherein said intermediate pivot members are clam-shelled between corresponding pairs of said substantially vertical walls of said molded cover of said circuit breaker housing and said substantially vertical walls of said molded base of said circuit breaker housing at or about said intermediate portion of said circuit breaker housing.

18. An electrical switching apparatus comprising:

a housing including a molded cover and a molded base;

a stationary contact assembly having a plurality of stationary electrical contacts; and a movable contact assembly including at least one carrier assembly, each of said at least one carrier assembly comprising:

a first carrier member, a second carrier member, a plurality of movable contact arms pivotably coupled between said first carrier member and said second carrier member, a plurality of movable electrical contacts coupled to said movable contact arms and being movable into and out of electrical contact with said stationary electrical contacts of said stationary contact assembly, a pivot extending outwardly from said first carrier member and said second carrier member, and a pivot assembly comprising:

a plurality of pivot members, each of said pivot members including an aperture pivotably receiving said pivot of a corresponding one of said at least one carrier assembly in order that said corresponding one of said at least one carrier assembly is pivotably coupled between a pair of said pivot members, wherein each of said pivot members of said pivot assembly is a separate independent component disposed between said molded cover of said housing of said electrical switching apparatus and said molded base of said housing of said electrical switching apparatus, and wherein one of said substantially vertical walls of one of said corresponding pairs of said substantially vertical walls of said circuit breaker housing comprises at least one recess; wherein the other of said substantially vertical walls of said one of said corresponding pairs of said substantially vertical walls of said circuit breaker housing comprises at least one protrusion; and wherein each of said pivot members of said pivot assembly comprises at least one protrusion received by said at least one recess of said one of said substantially vertical walls, and at least one cut-out portion received by said at least one protrusion of the other one of said substantially vertical walls.

19. The electrical switching apparatus of claim 15 wherein each of said substantially vertical walls of said molded cover of said circuit breaker housing and said substantially vertical walls of said molded base of said circuit breaker housing has a first thickness; wherein each of said pivot members of said pivot assembly has a second thickness; and wherein said second thickness of said pivot members of said pivot assembly is equal to or greater than said first thickness of said substantially vertical walls of said circuit breaker housing, in order that said pivot members provide a dielectric barrier between the poles of said circuit breaker.

20. The electrical switching apparatus of claim 14 wherein said pivot of said at least one carrier assembly comprises at least one pivot pin extending substantially perpendicularly from said first carrier member of said at least one carrier assembly and said second carrier member of said at least one carrier assembly; wherein each of said pivot members of said pivot assembly comprises a one-piece molded member; wherein the substantially circular aperture of said one-piece molded member comprises a substantially circular pivot recess having a full, continuous circumference; and wherein said substantially circular pivot recess receives a corresponding one of said at least one pivot pin of said at least one carrier assembly.

* * * * *